US009970730B2

(12) United States Patent
Thacker, Jr.

(10) Patent No.: US 9,970,730 B2
(45) Date of Patent: May 15, 2018

(54) ARCHERY BOW OVERDRAW SENSING AND LIGHT INDICATOR SYSTEM

(71) Applicant: Donald Curtis Thacker, Jr., Wingo, KY (US)

(72) Inventor: Donald Curtis Thacker, Jr., Wingo, KY (US)

( * ) Notice: Subject to any disclaimer, the term of this patent is extended or adjusted under 35 U.S.C. 154(b) by 0 days. days.

(21) Appl. No.: 15/472,800

(22) Filed: Mar. 29, 2017

(65) Prior Publication Data

US 2017/0284762 A1 Oct. 5, 2017

Related U.S. Application Data

(60) Provisional application No. 62/316,774, filed on Apr. 1, 2016.

(51) Int. Cl.
*F41B 5/14* (2006.01)

(52) U.S. Cl.
CPC ..... *F41B 5/1434* (2013.01)

(58) Field of Classification Search
CPC ..... F41B 5/14; F41B 5/1434; F41B 5/10
USPC ..... 124/86, 88, 23.1, 25.6
See application file for complete search history.

(56) References Cited

U.S. PATENT DOCUMENTS 4,134,383 A * 1/1979 Flood ..... F41B 5/14 124/25.6
4,179,613 A * 12/1979 Koren ..... F41G 1/467 124/87
4,572,153 A * 2/1986 MacPherson ..... F41G 1/467 124/24.1
4,689,887 A * 9/1987 Colvin ..... F41G 1/467 124/87
4,741,320 A * 5/1988 Wiard ..... F41B 5/1476 124/23.1
4,813,150 A * 3/1989 Colvin ..... F41G 1/467 33/265
5,060,626 A * 10/1991 Elliott ..... F41B 5/10 124/23.1
5,435,292 A * 7/1995 Armstrong ..... F41B 5/14 124/25.6
7,086,298 B1 * 8/2006 Colman ..... F41A 31/00 73/862.51
7,337,773 B2 * 3/2008 Simo ..... F41B 5/143 124/44.5
8,899,220 B2 * 12/2014 Morris, II ..... F41B 5/1484 124/23.1
2007/0068270 A1 * 3/2007 Coffey ..... G01G 19/14 73/760

(Continued)

FOREIGN PATENT DOCUMENTS

FR 2562226 10/1985

*Primary Examiner* — Alexander Niconovich
(74) *Attorney, Agent, or Firm* — Briggs and Morgan, P.A.; Daniel A. Rosenberg

(57) ABSTRACT

Archery bow overdraw or under draw sensing system is comprised of four main parts: (1) a force sensing resistor (FSR) on the bow limb near a cam between the draw stop on the cam and the bow limb where the draw stop rests on the bow limb at full draw or on the grip; (2) at least one LED light mounted on or adjacent to the bow sight; (3) a controller for reading the force of the draw stop on the force sensing resister (FSR) and controlling the on/off function of the LED; and (4); and a power source for the system.

19 Claims, 13 Drawing Sheets

(56) References Cited

U.S. PATENT DOCUMENTS

| | | | | |
|---|---|---|---|---|
| 2007/0151552 | A1* | 7/2007 | Czemske | F41B 5/10 124/86 |
| 2013/0098344 | A1* | 4/2013 | Morris, II | F41B 5/1484 124/25.6 |

* cited by examiner

ARCHERY BOW OVERDRAW SENSING AND LIGHT INDICATOR SYSTEM

RELATED APPLICATIONS

This application claims priority to and incorporates by reference U.S. Provisional Application No. 62/316,774 filed on Apr. 1, 2016.

BACKGROUND OF THE INVENTION

Field

The present invention relates to a force sensor mounted on a bow that measures the tension on the bow against a preset optimum tension, and provides feedback to the archer when the optimum setting is reached.

Background

Compound bows are well known in the art. There are various types of compound bow, however all of them share a common characteristic, namely, the use of a levering system, usually of cables and pulleys/cams, to reduce the tension required to bend the limbs of the bow as the bow string is drawn back.

The pulley/cam system grants the wielder a mechanical advantage, and allows for the use of limbs that are much stiffer than those of a recurve bow or longbow. This rigidity makes the compound bow more energy-efficient than other bows, as less energy is dissipated in limb movement. The higher-rigidity, higher-technology construction also improves accuracy by reducing the bow's sensitivity to changes in temperature and humidity.

The pulley/cam system also confers a benefit called "let-off." As the string is drawn back, the pulleys rotate. The pulleys are eccentric rather than round, and so their effective radius changes as they rotate. The pulleys feature two cam tracks—an inner cam track which connects mechanically to the limbs or opposite cam and an outer cam track which the bowstring runs through. As the bow is drawn the ratio of bowstring pay-out and bowstring take-up relative to limb-weight and leverage of the cams changes. By manipulation of the shapes of these cam tracks, different draw-stroke profiles can be created. A compound bow can be soft-drawing with a slow build-up to peak weight and a gradual let-off with a long "valley" at the end. It can also be hard-drawing with a very fast build-up to peak draw-weight, a long plateau where weight is maintained, and a quick let-off with a short valley. The let-off itself is the result of the cam profiles having passed center and approaching a condition very similar to a cam-lock. In fact some compound bows, if the draw-stops or draw-length modules are removed, will self-lock at full draw and require professional equipment to unlock safely.

The common parts of a compound bow are shown in FIG. 1 for reference.

As shown in FIG. 2, located on either or both of the idler cam or the cam a draw stop DS is located, which as the bow is drawn will strike the upper limb UL or lower limb LL respectively to indicate that the bow is fully drawn. The draw stop normally comprises a peg that affixed to the cam which physically stops the cam from moving when the draw stop engages with the limb.

Unfortunately, the draw stop is not as effective of an indicator of proper tension as it appears. It is not always apparent when the stop is engaged, and the stop can be over engaged, resulting in the bow being under or over drawn. For example, when the archer is in a high pressure or tense situation, the archer's body will build up tension. When the archer builds up tension, the archer cannot feel how hard he is pulling on the bow string or into the bow. Some archers get weak. In other words, the archer will think he is completely against the stops and has actually let up 1/16" or 1/8" (or more), which will cause the archer to shoot high in most cases. Depending on the tuning of the bow, the bow could shoot 6" plus high at 40 yards. Other archers may pull so hard the cams over rotate and cause the archer to miss low. This high pressure tense situation is true in hunting and target archery.

Additionally, archers may desire greater pressure feedback than is possible with a draw stop DS. The draw stop DS is generally provides go/no-go feedback, however, there is a great deal of pressure ranges between when the draw stop DS first impacts the limb and when it is fully engaged; however, prior art devices do not provide a way to detect or provide feedback to the archer over this range.

There is a need for an archery bow over draw and under draw sensing system that will give the archer notice to adjust his draw tension on the bow string to make sure the bow is in ideal shooting position in relation to the bow string, cams, and the draw stops resting on the limb or limbs.

SUMMARY OF THE INVENTION

An archery bow overdraw or under draw sensing system is comprised of four main parts: (1) a force sensing resistor to measure the tension in the bow string; (2) at least one light mounted on or adjacent to the bow sight; (3) a controller for reading the force from force sensing resister and controlling the on/off function of the light; and (4); and a power source for the system.

A principal object and advantage of the present system is that it is mounted on a compound bow that informs the archer/hunter of the force being applied to the bow after it reaches full draw. This allows the archer/hunter to release the arrow at the exact same point with the exact same amount of bow string tension every time—no matter the surrounding circumstances (nervous or scared) or the experience level of the archer.

DETAILED DESCRIPTION

Figure 1:
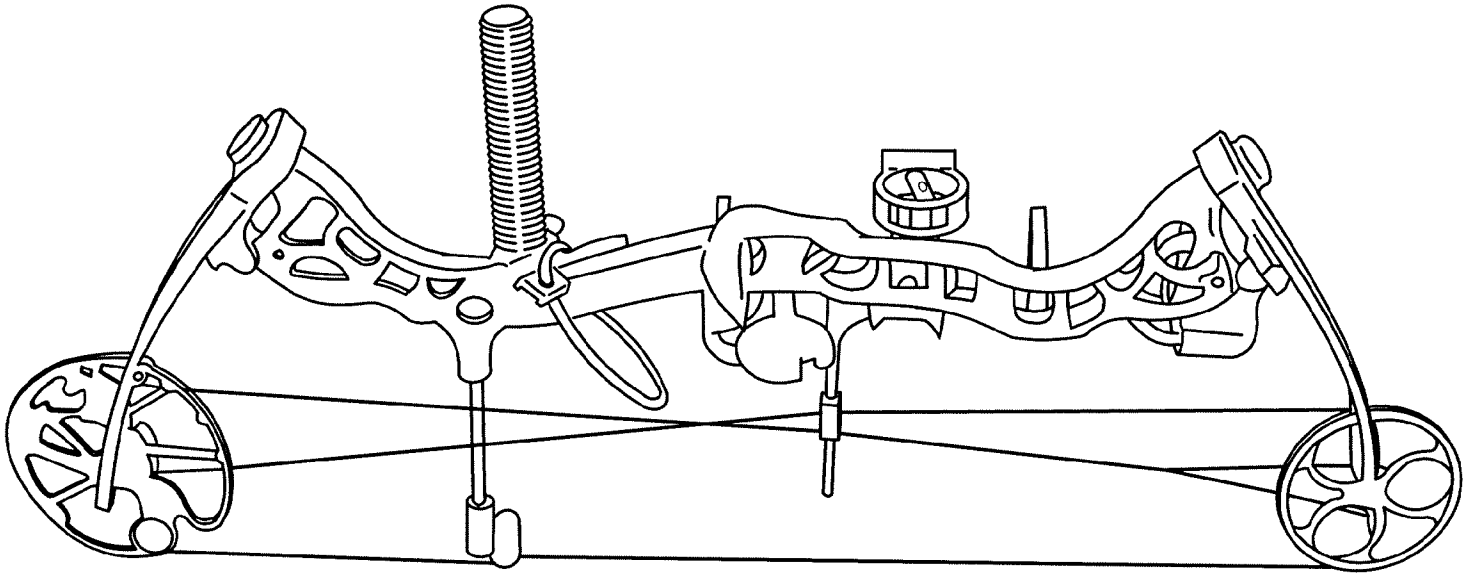
FIG. 1 (PRIOR ART)
FIG. 1 shows a prior art compound bow.
Figure 2:
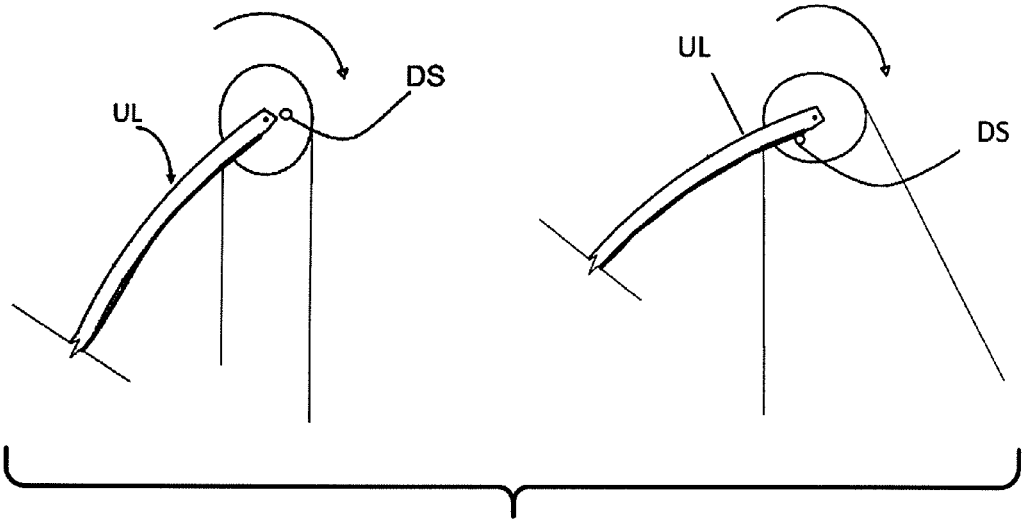
FIG. 2 (PRIOR ART)
FIG. 2 shows a prior art cam and draw stop of the bow.
Figure 3A:
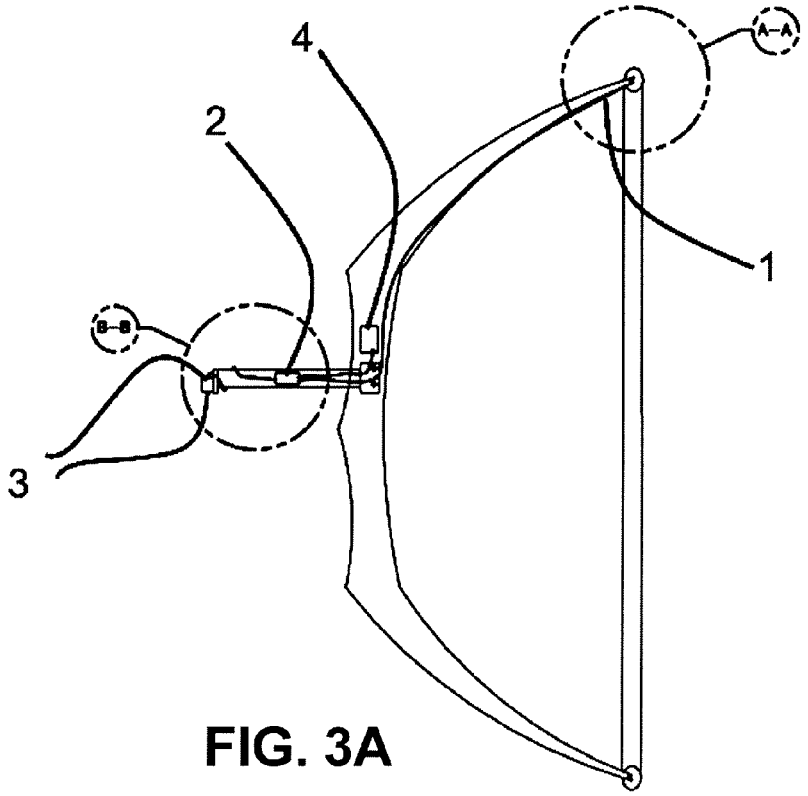
FIG. 3A shows the parts of the present invention located on the bow.
Figure 3B:
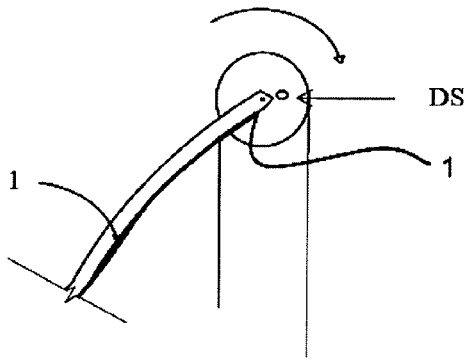
FIGS. 3B and 3C show a close up view of the force sensor of the present invention on the limb of the bow, with the draw stop in its resting position and with the draw stop engaged with the force sensor as the bow is fully drawn.
Figure 3C:
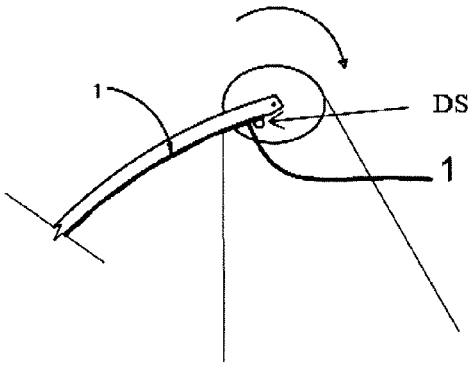

In the Figures is shown an archery pressure apparatus. In particular, FIGS. 3A-C show the parts describes below, where each part labeled with a reference numeral corresponding to the part number below.

Definition of Parts:

1. FSR

A force-sensitive resistor (alternatively called a force-sensing resistor or simply an FSR) 1 has a variable resistance as a function of applied pressure. In this sense, the term "force-sensitive" is misleading—a more appropriate term would be "pressure-sensitive," since the sensor's 1 output is dependent on the area on the sensor's 1 surface to which force is applied.

Figure 4:
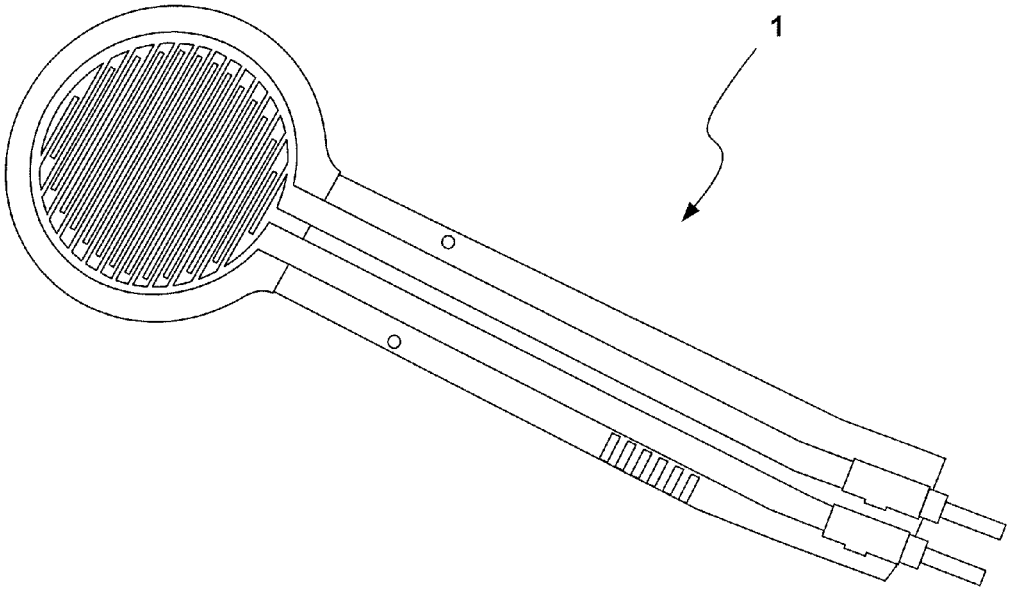
FIG. 4 show the force sensor.

Force sensing resistor 1 (see FIG. 4) for this invention maybe a 0.5 inch diameter, 1 oz, 22 pound flexible resister 1 made by Pololu, Part Number 1696, UNSPSC Code 32121600 (the invention is not necessarily limited thereby). The invention can use other types of sensors such as strain gauges; load cells that use transducers to convert into measurable electrical outputs or hydraulic, pneumatic, piezoelectric, and capacitive load cells; or other types of force measuring system such as elastic devices, magneto-elastic devices, vibrating elements, gyroscopic load cells, or plastic deformation devices. Any of the foregoing can be used provided that they are of a size appropriate hereto.

Figure 5:
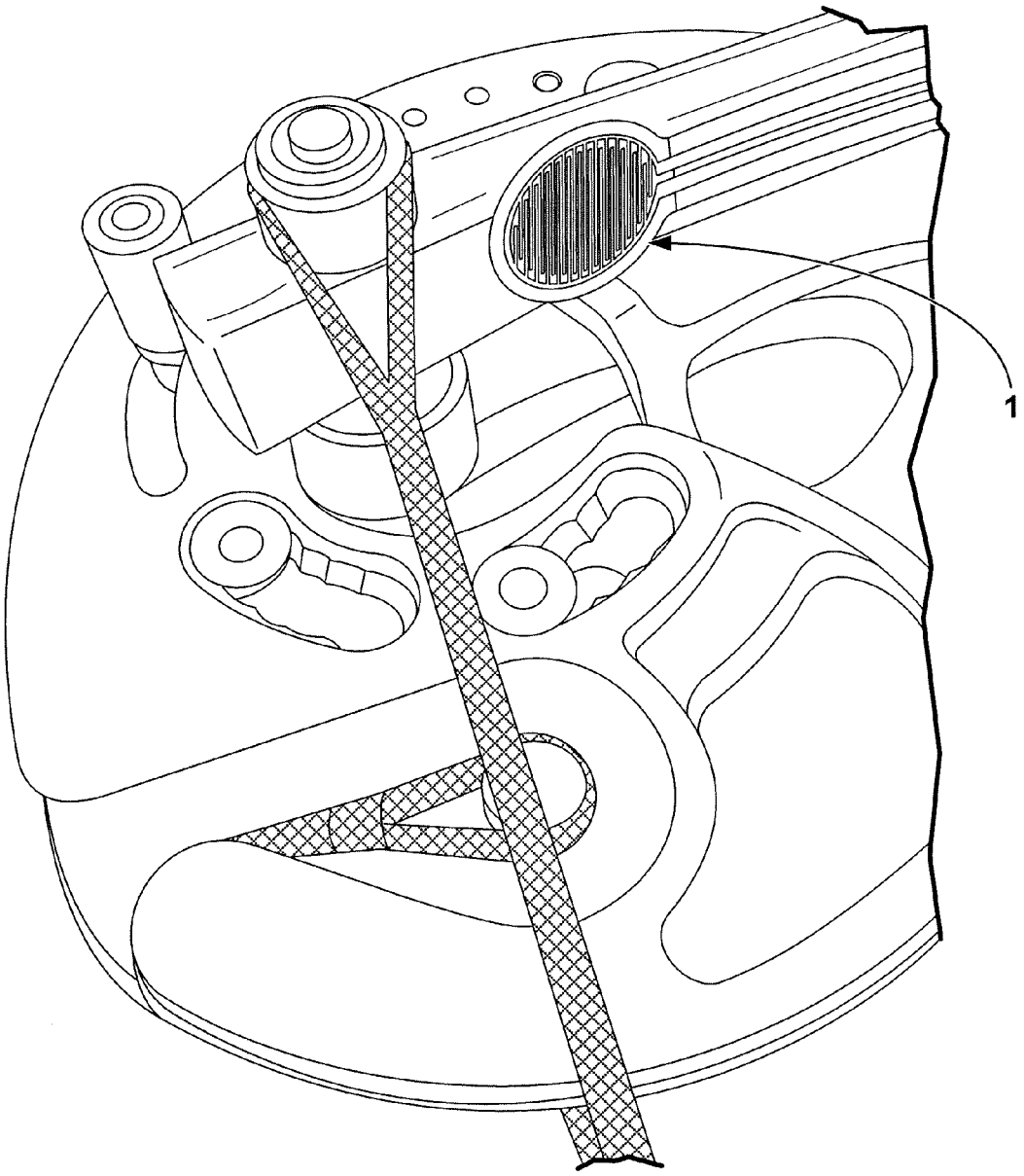
FIG. 5 is a close up view of the sensing pad of the force sensor.

The location of this resistor 1 on the bow limb is as shown in FIG. 5. The resistor 1 is located on the terminal end of the either limb, but preferable the on the upper limb. In this position the draw stop DS will impact the pad of the resistor 1, as the draw stop DS approaches the limb.

Figure 6:
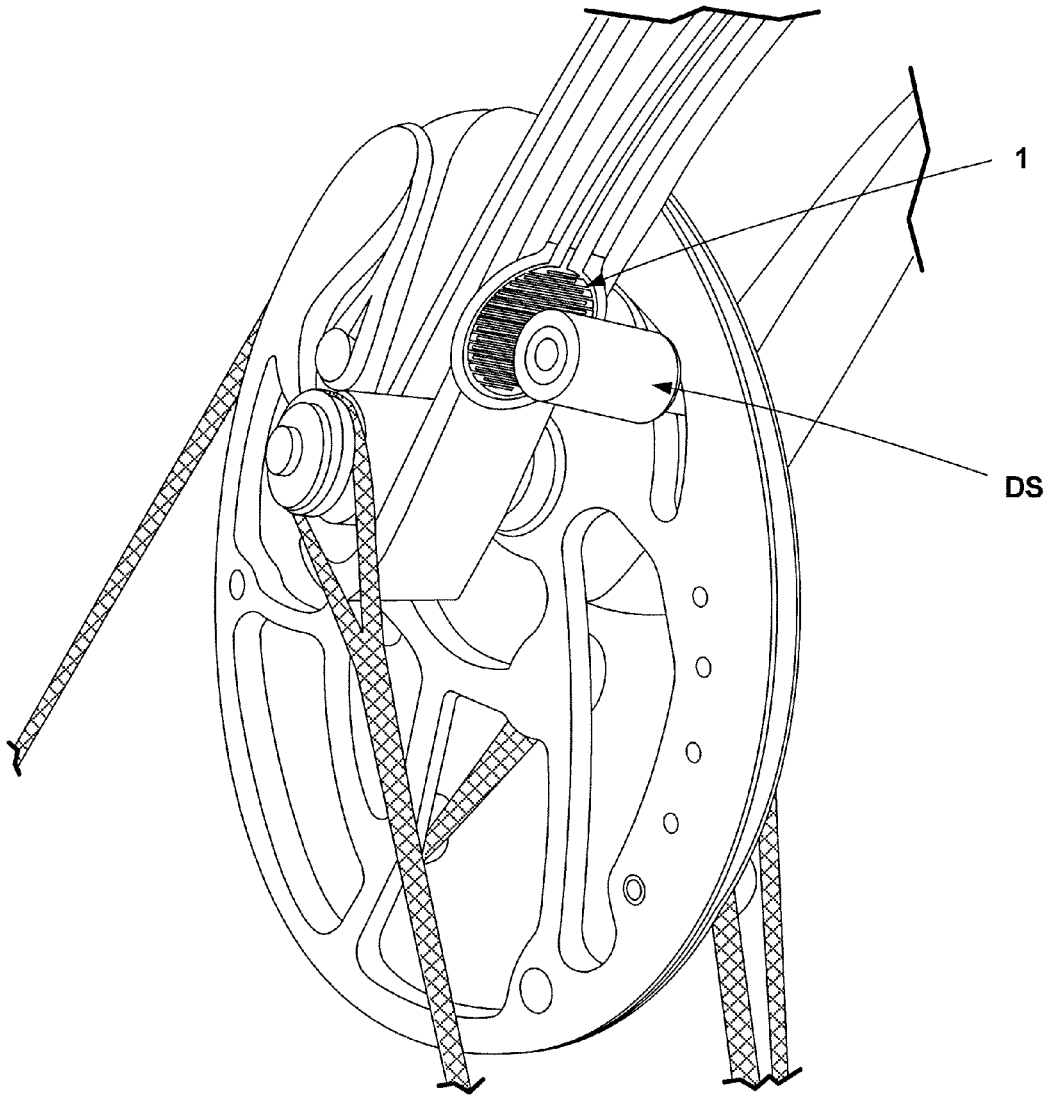
FIG. 6 is a close up view of the sensing pad of the force sensor engaged with the draw stop.

FIG. 6 shows the point of contact between the draw stop DS and the resister 1. The resistor 1 can measure the amount of pressure between the draw stop DS and the limb and provide a higher degree of pressure feedback than is possible without the resistor 1.

In one embodiment, the FSR 1 is fabricated with elastic material in four layers, consisting of: 1) a layer of electrically insulating plastic; 2) an active area consisting of a pattern of conductors that are connected to the leads on the tail of the resistor 1, which are charged with an electrical voltage; 3) a plastic spacer which includes an opening aligned with the active area and an air vent through the tail; and 4) a flexible substrate coated with a thick polymer conductive film, aligned with the active area. This polymer is often replaced by a layer of FSR ink.

When external force is applied to the sensor 1, for example from the draw stop DS, the resistive element is deformed against the substrate. Air from the spacer opening is pushed through the air vent in the tail, and the conductive material on the substrate comes into contact with parts of the active area. The more of the active area that touches the conductive element, the lower the resistance.

FSRs 1 exhibit a "switch like response," meaning some minimal amount of force is necessary to break the sensor's resistance at rest (approximately 1 MΩ), and push it into the measurement range (beginning at approximately 100 KΩ). FSR 1 can typically sense tension in increments of about ±5% of the tension on the bow string. Typical tension on a full draw compound bow is on range of between 5-30 lbs (the "holding tension").

When the draw stop DS comes into contact with the resister 1 on the limb, the resister will begin to measure the additional amount of force applied to the bow string by the archer. Based on experience, the preferred amount of tension on bow string is, for most bows is when they reach full draw plus 1 lb; however, this can and will vary from archer to archer and depending on the situation. The invention allows the archer to tailor the tension to suit particular needs, abilities, and preferences.

2. Microcontroller

Figure 7:
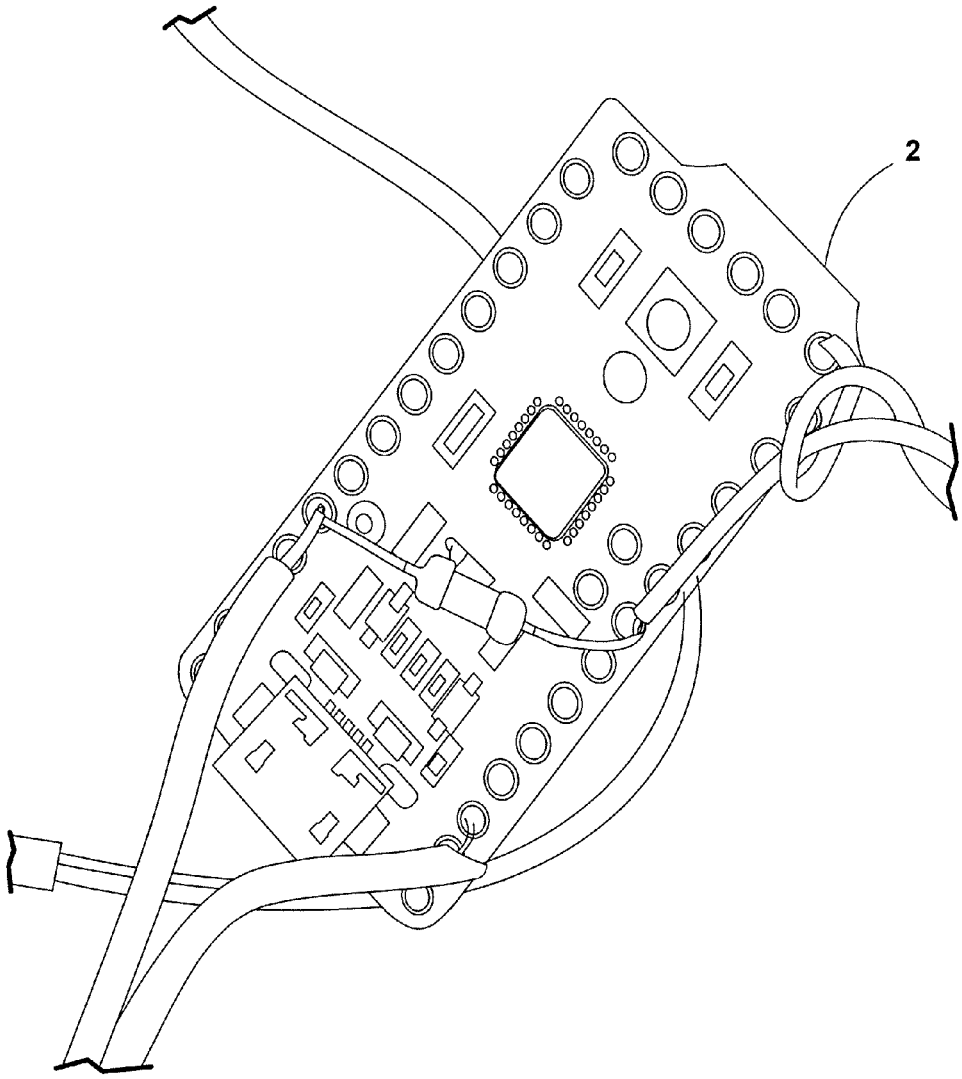
FIG. 7 shows a version of the controller.
Figure 8A:
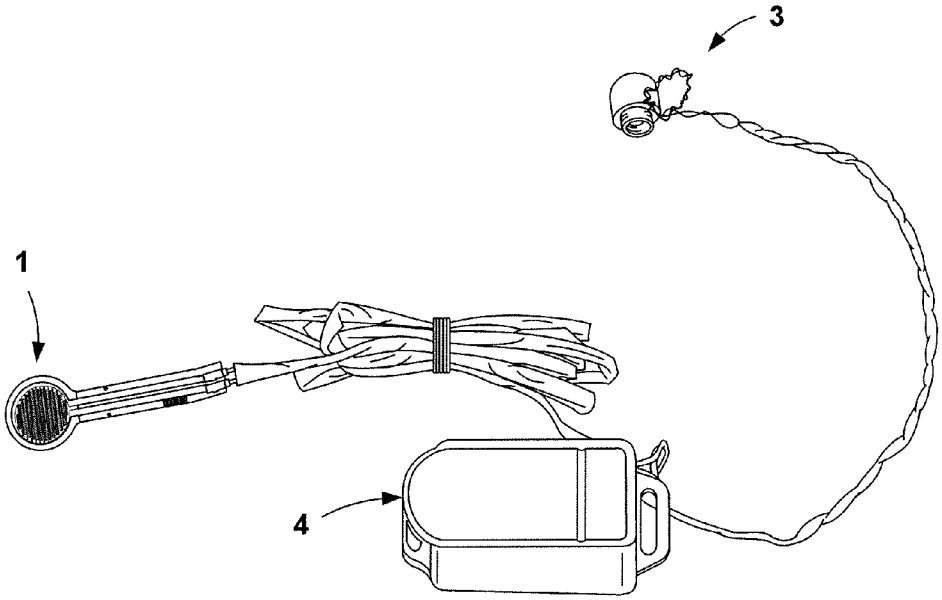
FIG. 8A shows the components of the invention featuring a single LED while not mounted on the bow.
Figure 8B:
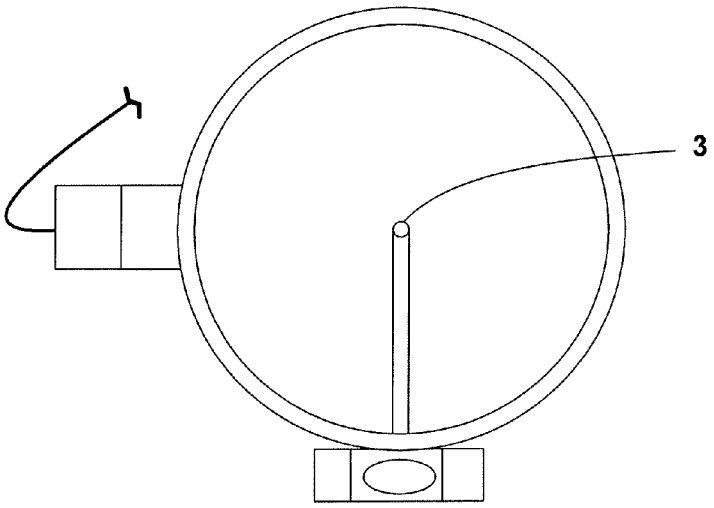
FIG. 8B is a close up view of the site LED on the site.

A microcontroller 2 is a small computer on a single integrated circuit containing a processor core, memory, and programmable input/output peripherals. Program memory in the form of Ferroelectric RAM, NOR flash or OTP ROM is also often included on the chip, as well as a typically small amount of RAM. In the preferred embodiment the controller is a commercially available microcontroller called an AVR Pro Trinket 5V 16 MHz made by Adafruit, Part Number 2000, UNSPSC Code 32000000 (Shown in FIG. 7). Of course, the invention is not so limited.

3. Led

A light-emitting diode (LED) 3 is a two-lead semiconductor light source. It utilizes a p-n junction diode, which emits light when activated. When a suitable voltage is applied to the leads, electrons are able to recombine with electron holes within the device, releasing energy in the form of photons or light.

In this archery pressure system, the above defined three main parts are used. The Micro controller 2 is programmed so that when it receives a predetermined amount of resistance (X) from the FSR 1 it turns on the LED 3 to alert the archer that they are in the sweet spot (optimum amount of pressure applied to the bow for maximum accuracy). Alternatively, an array of LEDs can be used to indicate pressure, where the LEDS begin to light up as the pressure approaches the predetermined sweet spot, and after the sweet spot has been passed.

In one embodiment of the invention, when the sweet spot is sensed by the LED which is located on the sight pin on the bow to inform the archer that it is at full draw and can take the shot.

In the preferred embodiment, the LED is a commercially available product called an LP Archery Pro-Light DX Replacement LED item #2980003, Catalog Page #129, *Thread Size ⅜ 32 HO. The invention, however, is not so limited.

4. Power Source

The power source 4 in the preferred embodiment commercially is a commercially available product called a Chinatera 5 pcs Black 2×3V CR2032 Battery Round Button Cell Coin Holder Case Box Cover Wire Lead ON/OFF Switch, Part Number 78495, Item model number 78495, Color Black Voltage 6 volts, Item Package Quantity 5, Battery Cell Type Lithium Metal. Of course, the invention is not so limited.

In operation, the following steps are followed:

1. Turn on switch to activate the power source 4.
2. Load arrow and draw bow in the normal manner.
3. Observe LED 3, which is located in a position that is in the archer's site line (when the bow is fully drawn the draw stop will contact the pressure sensor (FSR) 1 which will send a signal to the microcontroller 2 which will illuminate the LED 3 and the sight pin/pins will illuminate).

4. Once LED 3 is illuminated the arrow can be fired, in an accurate and ethical manner, because the archer is in the bow string pressure sweet spot.
5. If the LED 3 turns off, after having been on, then the archer has passed the sweet spot, over straining the draw stop, and needs to relax the tension on the bow until the LED 3 illuminates before firing the arrow.
6. Turn off the switch on the power source 4 when finished shooting or hunting.

Figure 9A:
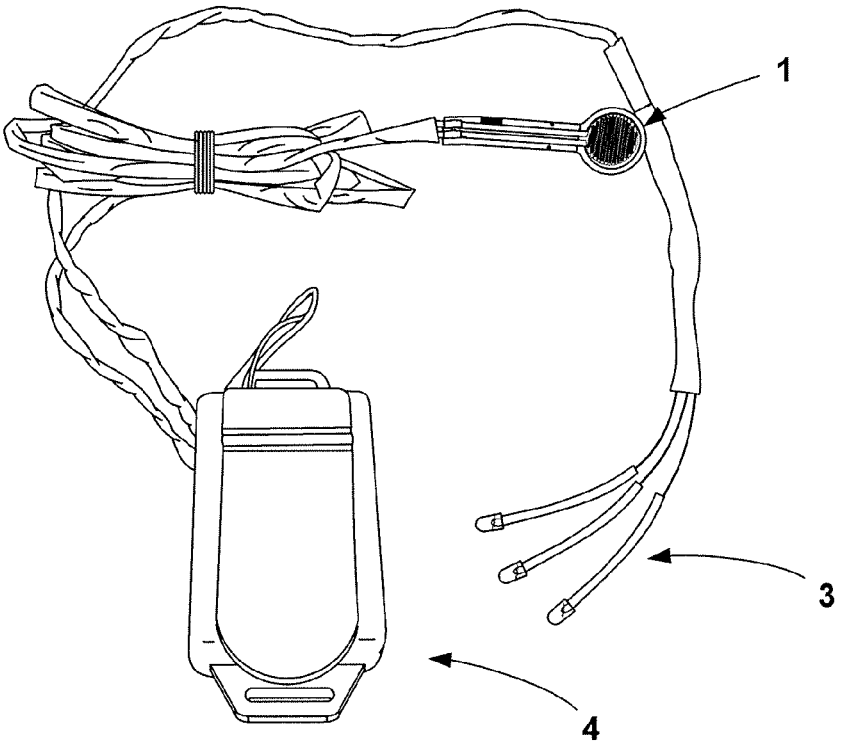
FIG. 9A shows the components of the invention featuring 3 LEDS while not mounted on the bow.
Figure 9B:
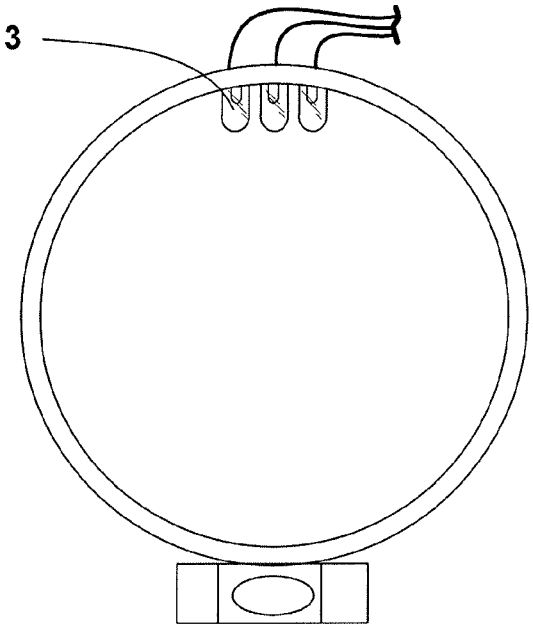
FIG. 9B is a close up view of the site with the 3 LEDS mounted thereto.

In another embodiment of the inventions, shown in FIGS. 9A and 9B, the microcontroller 2 will receive the signal from the FSR 1 and will turn on a series of LEDs 3 informing the archer if he needs to pull harder, relax, or stay where they are at—so as to fire the most accurate shot possible. For example, a pink LED could indicate that the desired pressure has not been reached and the archer needs to pull harder, a red LED could indicate that archer has passed the desired pressure and needs to let off, and a green LED could indicate the sweet spot.

The three set LED 3 is a commercially available product called a Lighthouse LEDs 5×3 mm 6 v Pre-Wired Pure Green LED, Ultra Bright (4 v, 5 v, 6 v), Brand Name Lighthouse LEDs, Part Number 5X6V3MMPREWIREDPUREGREEN, UNSPSC Code 32111503. The invention is not necessarily so limited.

In operation, for use, the following steps are applicable:

1. Turn on the power source switch 4.
2. Load arrow and draw bow in the normal manner.
3. Observe LED's 3 (when the bow is fully drawn the draw stop on the cam will contact the pressure sensor (FSR) 1 and will send signal to the Microcontroller 2 which will illuminate the LEDs 3 corresponding with the amount of pressure on the pressure sensor (FSR) 1.
   - 3a. The pink LED 3 will illuminate when the archer is near the optimum predetermined pressure (pull harder/add slight pressure to bow)
   - 3b. The Green LED 3 will illuminate when the archer is the sweet spot (most accurate pressure to fire the bow), and can shoot when sight aligned and Green LED 3 is illuminated.
   - 3b. The Red LED 3 will illuminate when the archer has put too much pressure on the bow (relax a little till red LED 3 goes off).
4. Turn off power source 4 switch when you are finished shooting or hunting.

The sweet spot is customizable to be able to set when the LED 3 light comes on in, or when the appropriate of a series of LEDs 3 is illuminated. The microcontroller is programmable to define the desired pressure setting corresponding to the applicable LED 3. This can be configured based on manufacture standards, or customized by the archer.

In the multiple LED configuration, the first LED (pink) will have a default setting to illuminate when the FSR 1 senses about 1 k ohm of resistance, which corresponds to about 1 oz. of pressure/force applied after the draw stop makes contact with the FSR 1. The second LED (green) will have a default setting of about 500 ohms of resistance, which corresponds to about 0.75 lb of pressure/force applied after the draw stop makes contact with the FSR 1. This is the optimum resistance for most bows to fire the arrow the most accurately. The third LED (red) will have a default setting of about 200 ohms or resistance, which corresponds to about 2.5 lbs of pressure/force applied after the draw stop makes contact with the FSR 1. At this point the cams start to over rotate and accuracy begins to diminish. FSR manufacturers claim accuracy to be +/−5 percent. So even at the highest pressure level (the red LED), even a 10% variation in the ability of the FSR 1 to detect pressure should not affect accuracy (10% of 2.5 lbs is only 113 grams which is a small enough amount that it should not affect the accuracy of the archer). Of course, these settings can and will vary depending on the bow, archer, and desired outcome. Also, the archer can configure the device to personalize the settings.

An additional embodiment of the invention allows for use of the invention in bows with or without cams. In particular, draw stops are not necessary used in all compound bows. Cable stops can be used instead. A cable stop is a peg attached to the cam that rolls around as the bow is drawn but impacts the cables instead of the limb. A force sensor cannot be used on the cable itself. Also, non-compound bows do not have cable or draw stops. In these situations, the force sensor can be mounted to the grip, where the grip can sense the pressure the archer exerts against the grip as the bow is drawn. The force sensor can be covered with tape to protect it.

Figure 10:
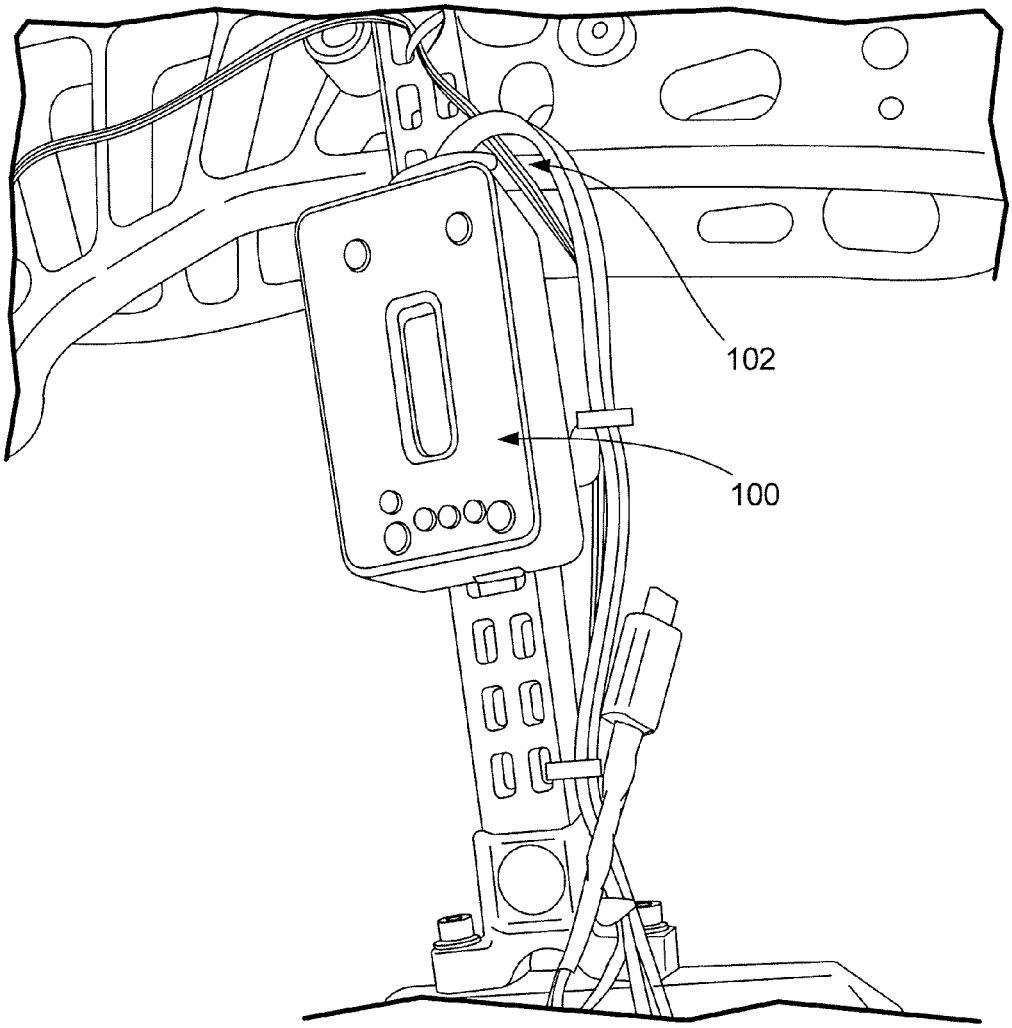
FIG. 10 shows an alternative controller mounted on the site bar.

In another embodiment of the invention another controller 100 is used (See FIG. 10). In this embodiment, the microcontroller includes an analog to digital converter and for this embodiment the controller is programmed to change analog signal from the force sensor to digital so the microcontroller can display a discrete signal value to the archer. The controller 100 includes an organic light emitting diode (OLED) screen to display the numeric pressure value, and that allows for the archer to more easily program the device. Preferably, the OLED screen is a 64×128 bit screen that displays brightness levels, allows for adjusting the brightness levels to suit the conditions, and includes menus that allow the archer can select "low" and "high" force settings according to the archer's preference. The range between the low and high setting defines the sweet spot. Pressure below the low setting the bow is underdrawn; above the high setting the bow is overdrawn. The tolerance between the low and high setting can be loosened and tightened as desired, and preferably tightened as the archer gains more precise control over the precise release tension.

In more detail, the controller 100 includes a PC card with a configurable op-amp; a 12-bit analog-to-digital converter, Li-ion battery charger, battery boost circuit, power supply, LED illuminator control, four PB switches for menu selection for menu selection and power-on, a ESP8266 microcontroller which includes Wi-Fi and antenna, USB to UART bridge and power supply.

Figure 13:
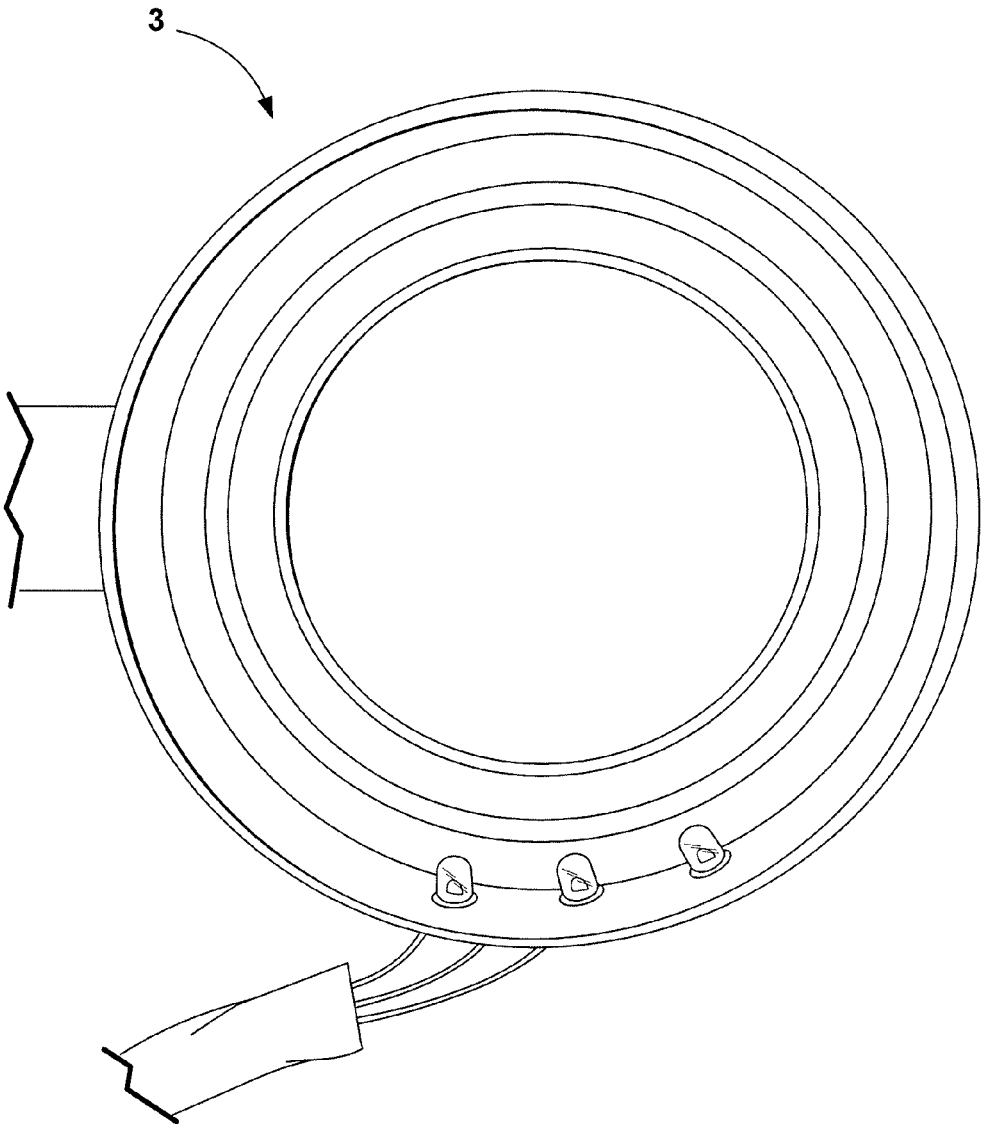
FIG. 13 show the lights on the site ring.

The controller 100 also includes three fiber optic leads 102 that carry light from internal LEDS to a position on the site visible to the archer when shooting. The controller 100 mounts to the bow site arm, but could be positioned elsewhere. The controller 100 also includes four buttons or switches, the function of which is described below. FIG. 13 shows the site ring with the LEDS attached thereto.

The microcontroller can store on memory the force readings at firing. In the preferred embodiment it stores the last 100 firings. A menu screen allows the archer to view the saved data to get feedback on the accuracy and precision of bow tension. The invention includes a USB to connect the controller 100 to a power source also mounted on the bow. The controller 100 has a wireless connection allows the microcontroller to download the information in real time to a smart phone or other device so that a virtually unlimited amount of information can be saved. The information can be downloaded after words, or the USB connection can be used to access the controller 100.

The pressure date from the controller 100 is used to display (on the OLED screen or on a connected device) a graph which shows the pressure profile before and after firing to all the archer to see how close to the optimum pressure they came, and if the pressure changed in any significant way at the time of firing.

The controller 100 can be used in both hunting and a training mode; the modes can be selected from the menu screen. In the hunting mode the LEDs will illuminate as described above to guide the archer toward the sweet spot. In other situations the archer may want to use the feedback from the system to try and improve their ability to obtain the optimum bow pressure without feedback from the controller 100. Thus, in the training mode the invention will record the pressure information, which can be later reviewed to determine how close to the sweet spot the archer was able to come. The hunting and training modes/options are described in more detail below.

Figure 11:
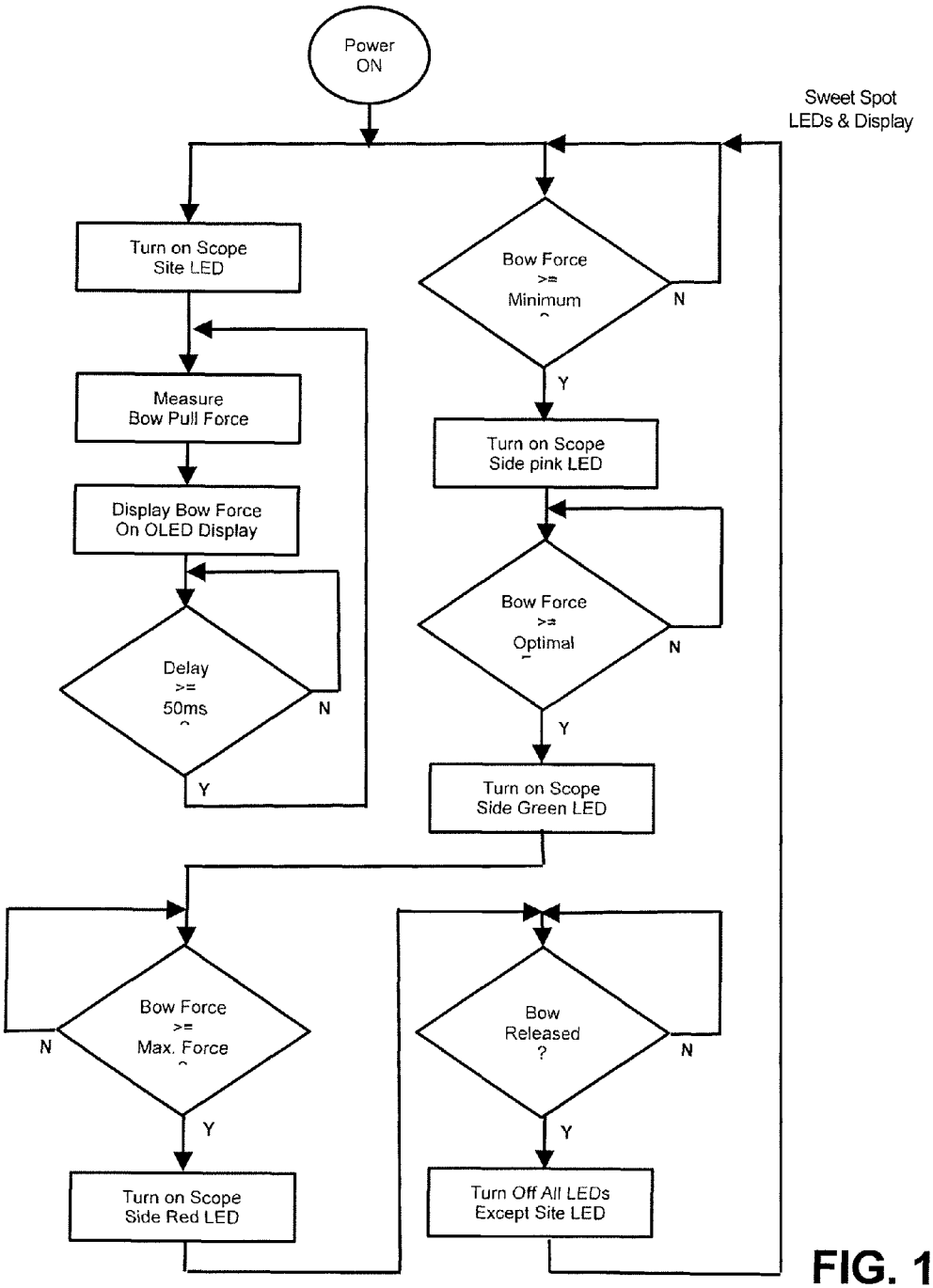
FIG. 11 is an operational flow chart.
Figure 12:
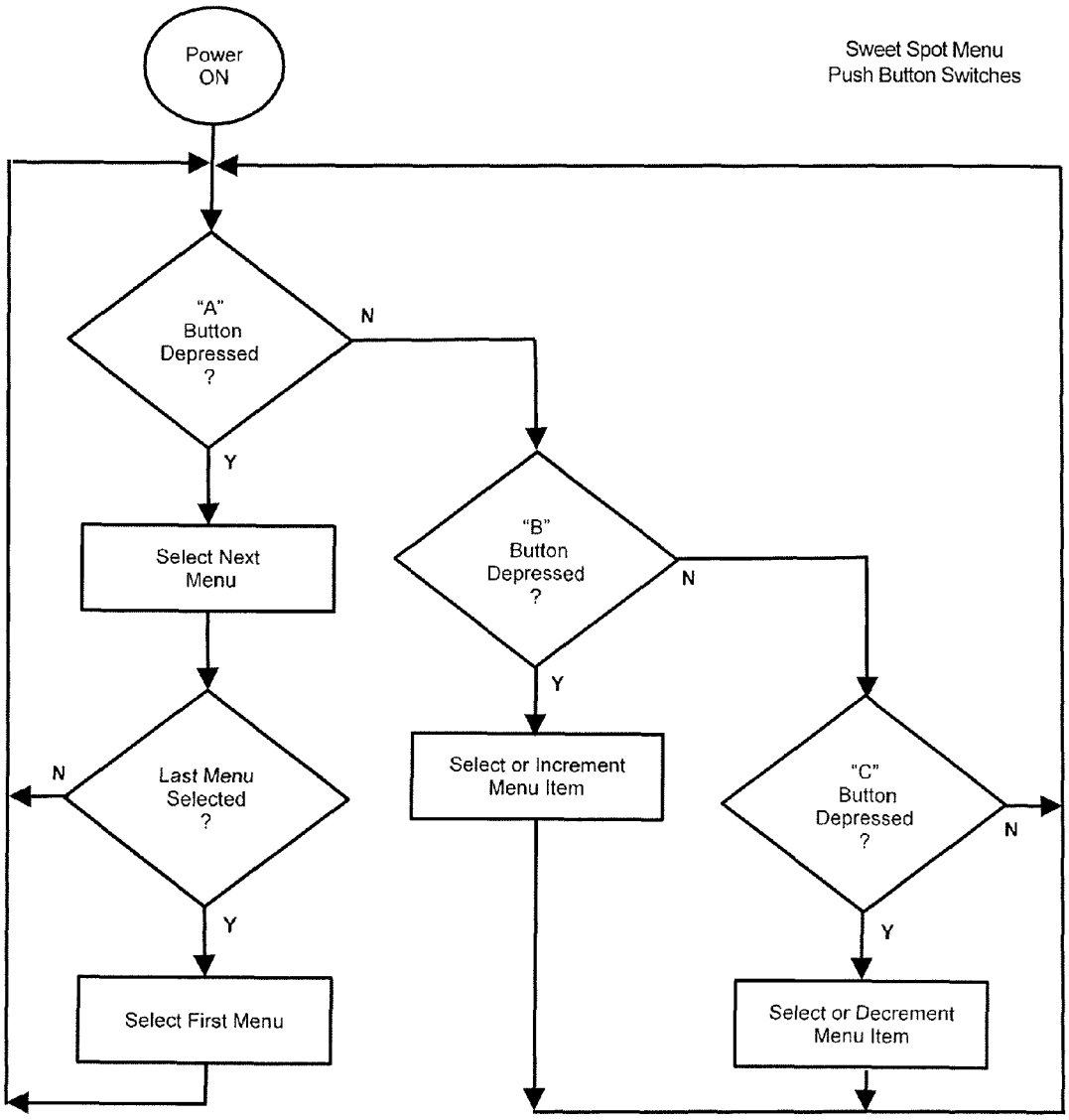
FIG. 12 is a configuration flow chart.

The following description of operation is in reference to the flow charts in FIGS. 11 and 12. FIG. 11 shows the flow for LED display and sweet spot sensing. First, the controller 100 is turned on with the power button which is one of the four buttons on the face of the controller 100. As indicated on the upper left side of FIG. 11, the controller samples the pressure from the force gauge approximately ever 50 ms, and updates the digital readout on the OLED screen. If the pressure reading is below the minimum level set for the sweet sport the pink LED is lit, sending a light signal through the corresponding fiber optic line to the site, indicating that the optimum pressure has not been reached. If the pressure reading is above minimum, but below the maximum, the green LED is lit indicating the sweet spot. If the pressure reading is above the maximum, the red LED is lit indicating the pressure is above the sweet spot. Once the bow is released the pressure drops dramatically and the LEDS are turned off—except for the site LED (if it is being used).

At any time the archer can scroll through the stored pressure readings for the previous shots, or can obtain the information from a separate device that has downloaded the information from the controller 100.

FIG. 12 shows the flow chart for setting up the sweet spot pressure settings. This features use three buttons on the fact of the controller 100, which are referenced as A, B, and C in FIG. 12. In particular, one button is used for menu selection (button A). In this case, the menus include setting the maximum and minimum pressure setting that define the sweet spot. Once a menu is selected the two buttons (B and C) are used to increment or decrement the pressure setting. Other menus are described herein, and the buttons are used in a similar manner, where the A button is used to select a menu, and the other two to make menu choices.

In the hunting version, the archer can enable the sight light when the archer reaches the stand, or other suitable location. One of the LEDs is used to send a signal through the fiber optic cable when the archer reaches the full draw pressure, or the invention can be modified to you use a single LED. The LED will illuminate when the optimum force is reached. If the LED goes off the archer can then apply more or less force to return to the optimum force setting.

The target version has a more complex version that allows allow the archer fire his arrow with the exact same amount of pressure every time. The target version uses the three LED lights described above that send a light signal through 0.010 fiber optic cables are running down the sight rod and mounted inside the scope housing. Each LED is preset to come on dependent on the pressure that is being applied to the sensor. The device is extremely accurate and triggers the corresponding LED in precise response to the force gauge.

At any time of the archer wants to disable the device they can turn off the controller, or simply unplug the fibers leaving the controller on to collect pressure data that can be reviewed later.

In practice, it is believed that the holding weight plus one pound of pressure is the accurate sweet spot setting, however, the LED's can be programmed to come on anywhere from 1 oz to 100 lbs. The system can come with preset values based on the type of bow, and is easily configurable thereafter.

The device is waterproof, to allow for use in the field without concern. The controller includes Wi-Fi capability and allows the archer to securing link to a particular mobile device, such as a smart phone, using a unique service set identifier (SSID) and password to avoid interference with other devices.

The present invention provides archers with a tool that can improve accuracy for beginners and professionals. They can learn to precisely controller the firing pressure on each and every shot. The sweet sport tolerance is completely configurable, and gives the archer the ability to start off using a broad range and fine tune the range as accuracy improves. Without this level of feedback, improvement is much slower or impossible.

The above specification and accompanying Figures are for illustrative use only. The scope of the present invention is defined by the following claims. The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention. Those of ordinary skill in the art that have the disclosure before them will be able to make modifications and variations therein without departing from the scope of the invention.

The invention claimed is:

1. An archery bow tension sensing system, comprising:

a force sensor mounted on a bow for continuously sensing a deflection force on a limb of the bow;

a controller in operative communication with the sensor; and an indicator for receiving a signal from the controller indicating that the force sensor has sensed an optimum force for release of the bow.

2. The system of claim 1 where the force sensor is mounted on the bow limb.

3. The system of claim 2 where the sensor senses force by coming into contact with a draw stop on a cam of the bow.

4. The system of claim 1 where the force sensor is mounted on a grip of the bow and sense force on the limb by sensing grip pressure.

5. The system of claim 1 where the indicator is a light and the light comes on when the optimum tension has been sensed.

6. The system of claim 5 where the light is an LED light.

7. The system of claim 1 where the indicator comprises 3 LED lights.

8. The system of claim 7 where one LED indicates an underdrawn condition, another indicated an overdrawn condition, and the third indicates an optimum condition.

9. The system of claim 7 where the LEDs can be seen from a site ring.

10. The system of claim 9 where fiber optic lines run from the controller to the site ring.

11. The system of claim 1 where the controller is programmable.

12. The system of claim 1 comprising a power supply to power the controller and force sensor.

13. The system of claim 1 where the sensor is a force sensing resistor.

14. The system of claim 1 where the controller stores force readings from a plurality of shots.

15. The system of claim 1 where the controller communicates with a mobile device.

16. The system of claim 15 where the controller communicates wirelessly.

17. The system of claim 1 where the controller has a screen and displays the optimum force.

18. The system of claim 1 where the bow is a compound bow.

19. The system of claim 1 where the controller is mounted on a site arm.

* * * * *